US009637933B2

(12) United States Patent
Zhou et al.

(10) Patent No.: US 9,637,933 B2
(45) Date of Patent: May 2, 2017

(54) SYSTEMS AND METHODS FOR INSTALLING CLADDING PANELS

(71) Applicant: SUNNYWEI GROUP INC., Richmond Hill (CA)

(72) Inventors: Yi Zhou, Richmond Hill (CA); Yu Liang, Richmond Hill (CA); Qichao Gong, Jingzhou (CN); Dongding Liang, Nankai District (CN); Zhou Zhou, Jingzhou (CN)

(73) Assignee: SUNNYWEI GROUP INC., Richmond Hill, Ontario (CA)

( * ) Notice: Subject to any disclaimer, the term of this patent is extended or adjusted under 35 U.S.C. 154(b) by 0 days.

(21) Appl. No.: 14/955,720

(22) Filed: Dec. 1, 2015

(65) Prior Publication Data

US 2016/0244967 A1 Aug. 25, 2016

Related U.S. Application Data

(60) Provisional application No. 62/118,751, filed on Feb. 20, 2015.

(51) Int. Cl.
*E04F 13/08* (2006.01)
*E04F 13/14* (2006.01)

(52) U.S. Cl.
CPC ..... *E04F 13/0801* (2013.01); *E04F 13/083* (2013.01); *E04F 13/0851* (2013.01); *E04F 13/14* (2013.01)

(58) Field of Classification Search
CPC . E04F 13/0805; E04F 13/083; E04F 13/0801; E04F 13/14; E04F 13/0851; E04B 2/96; E04B 1/61; E04B 2/88
See application file for complete search history.

(56) References Cited

U.S. PATENT DOCUMENTS 3,866,374 A * 2/1975 Dallen ..... E04B 2/967 52/204.593
3,968,608 A * 7/1976 Swango ..... E04B 2/96 52/127.12
4,194,333 A * 3/1980 Paton ..... E04B 1/4107 52/235
4,307,551 A * 12/1981 Crandell ..... E04F 13/0808 52/204.591

(Continued)

*Primary Examiner* — Beth Stephan
(74) *Attorney, Agent, or Firm* — Norton Rose Fulbright Canada LLP; Maya Medeiros

(57) ABSTRACT

A hanging system for securing cladding panel on a building structure, the cladding panel having a mounting channel extending at least partly across a surface thereof. An embedded anchor block has a core and two engaging portions outwardly projecting from the core, the two engaging portions operable to lock the anchor block in the mounting channel of the cladding panel in an interlocking fit when the embedded anchor block is received within the mounting channel, and the embedded anchor block having an outer surface that is configured to be flush or near flush with the surface of the cladding panel when the embedded anchor block is received within the mounting channel. A hanging clip removably connects or fastens to the anchor block, the hanging clip having an engagement surface to engage the outer surface of the anchor block. The cladding panel is secured to a building structure by fastening the anchor block to the hanging clip which is securable to a support.

20 Claims, 15 Drawing Sheets

(56) References Cited

U.S. PATENT DOCUMENTS

| | | | | | |
|---|---|---|---|---|---|
| 4,782,635 | A * | 11/1988 | Hegle | E04B 2/94 | 52/126.4 |
| 5,239,798 | A * | 8/1993 | Saito | E04B 2/92 | 52/235 |
| 5,548,939 | A * | 8/1996 | Carmical | E04B 1/4135 | 52/698 |
| 5,673,529 | A * | 10/1997 | Treister | E04C 2/288 | 52/235 |
| 5,699,639 | A * | 12/1997 | Fernandez | E04B 7/045 | 52/295 |
| 5,758,459 | A * | 6/1998 | Koike | E06B 1/524 | 52/204.5 |
| 6,158,182 | A * | 12/2000 | Biebuyck | E04B 2/96 | 52/204.53 |
| 7,654,057 | B2 * | 2/2010 | Zambelli | E04B 1/4107 | 411/82 |
| 8,468,765 | B1 * | 6/2013 | Kim | E04F 13/0835 | 52/235 |
| 8,555,577 | B2 * | 10/2013 | Maday | E04B 2/00 | 52/235 |
| 8,640,399 | B2 * | 2/2014 | Fradera Pellicer | B28B 5/04 | 52/124.2 |
| 2005/0188634 | A1 * | 9/2005 | Bolton | B32B 17/10036 | 52/235 |
| 2008/0311339 | A1 * | 12/2008 | Toncelli | B28B 23/005 | 428/99 |
| 2011/0078971 | A1 * | 4/2011 | Adams | A01N 37/44 | 52/517 |
| 2011/0094183 | A1 * | 4/2011 | Gasperi | E04B 2/94 | 52/705 |
| 2011/0107716 | A1 * | 5/2011 | Foley | E04B 1/2403 | 52/699 |

* cited by examiner

SYSTEMS AND METHODS FOR INSTALLING CLADDING PANELS

CROSS REFERENCE TO RELATED APPLICATION

This application claims the benefit of U.S. provisional application No. 62/118,751 filed Feb. 20, 2015 which is herein incorporated by reference in its entirety.

FIELD

The embodiments disclosed herein generally relate to the field of cladding, façade, and curtain walls. More specifically, the embodiments relate to anchoring cladding panels onto a building structure.

BACKGROUND

Stone, due to its rich colors, different varieties, elegant appearance, durability and other characteristics, is widely used as outdoor and indoor decoration material for all types of buildings. Synthetic materials are manufactured for all kinds of applications for not only their beautiful appearance and durability, but also their green and environmental-friendly characteristics. They are now very popular materials in the construction industry.

Due to the physical properties of stone, connecting or coupling the cladding panels with the main body of the building adds a certain degree of difficulty. In the traditional "wet adhesive" attaching method, such as using mortar or adhesive, the cladding panels in direct contact with the concrete block of building. It may seriously affect the decorative function and create many problems, even some safety issues. As comparing to the "wet adhesive" attaching method, some currently used fixing methods (dry-hanging methods) may overcome some of the above mentioned shortcomings by installing the cladding panels indirectly onto concrete surface of the building, such as through dowel pin anchor, Kerf anchor, undercut fastener (or back bolting) connection and so on. But these hanging processes also have their own deficiencies. For example, these processes need holes to be manually drilled or slots to be manually cut by workers on the construction site. Adhesive for fixing anchor on cladding panel is also applied on site. These processes require longer construction time, more operations and highly skilled workers, such as experienced masons. At the same time, there may be also negative impact on construction quality by climate or environmental factors, such as in cold winter time. Furthermore, certain facilities and equipment may be required to create the features on cladding panel, and a certain extent of environment pollution is inevitable. Among these commonly used installation methods, undercut fastener (or back bolting) connection may be an improvement over dowel pin and kerf anchors. For example, the main process is completed within the fabrication shop instead of on site, but its structure designed to take external forces carries a risk in creating relatively high stress in the cladding material. As a consequence, the method of undercut fastener connection still has some drawbacks, such as limitations imposed on the thickness of cladding material and the overall size of panel.

Accordingly there exists a need for improved methods and systems for cladding.

SUMMARY

In accordance with one aspect, there is provided a cladding panel assembly having a cladding panel comprising a mounting channel extending at least partly across a surface thereof. An embedded anchor block has a core and two engaging portions outwardly projecting from the core, the two engaging portions operable to lock the embedded anchor block in the mounting channel of the cladding panel in an interlocking fit when the embedded anchor block is received within the mounting channel, and the embedded anchor block having an outer surface that is configured to be flush or near flush with the surface of the cladding panel when the embedded anchor block is received within the mounting channel.

In some embodiments, the embedded anchor block has a dovetail shape.

In some embodiments, the mounting channel has a cross section complementary to a cross section of a shape of the embedded anchor block.

In some embodiments, the assembly has a hanging clip configured to removably connect or fasten to the embedded anchor block, the hanging clip having an engagement surface to engage the outer surface of the embedded anchor block, wherein the cladding panel is operable to be secured to a building structure by fastening the embedded anchor block to the hanging clip which is securable to a support.

In some embodiments, embedded anchor block has at least one bore extending inward from the outer surface, and the hanging clip having at least one corresponding bore to removably connect or fasten the hanging clip to the embedded anchor block.

In some embodiments, the hanging clip has a body and a flange projecting outwardly from the body, the body having the at least one corresponding slot or bore to the at least one bore of the embedded anchor block for removably connecting or fastening the embedded anchor block.

In some embodiments, adhesive material fills a gap between the embedded anchor block and an inner surface of the mounting channel when the embedded anchor block is received within the mounting channel. The adhesive material may be epoxy.

In some embodiments, the outer surface of the embedded anchor block has grooves thereon for preventing slippage when removably connected or fastened with the engagement surface of the hanging clip.

In some embodiments, the engagement surface of the hanging clip has grooves thereon for preventing slippage when removably connected or fastened with the embedded anchor block.

In some embodiments, the cladding panel has a reinforcing layer on the surface. The reinforcing layer may be in a form of at least one of cloth, mesh and grating.

In some embodiments, the hanging clip is configured for an adjustable connection to the embedded anchor block to provide a plurality of assembly configurations.

In some embodiments, the at least one bore on the body of the hanging clip is configured to provide vertical adjustment during cladding installation.

In another aspect, there is provided a kit for hanging a cladding panel onto a building structure, the cladding panel comprising a mounting channel extending at least partly across a surface thereof. The kit has an anchor block having a core and two engaging portions outwardly projecting from the core, the two engaging portions operable to lock the anchor block in the mounting channel of the cladding panel in an interlocking fit when the embedded anchor block is received within the mounting channel, and the embedded anchor block having an outer surface that is configured to be flush or near flush with the surface of the cladding panel when the embedded anchor block is received within the mounting channel. The kit has a hanging clip configured to removably connect or fasten to the anchor block, the hanging clip having an engagement surface to engage the outer surface of the anchor block, wherein the cladding panel is operable to be secured to a building structure by fastening the anchor block to the hanging clip which is securable to a support.

In some embodiments, the anchor block has at least one bore extending inward from the outer surface and wherein the hanging clip has at least one corresponding bore to removably connect or fasten the hanging clip to the anchor block.

In some embodiments, the hanging clip has a body and a flange projecting outwardly from the body, wherein the body having the at least one corresponding slot or bore to the at least one bore of the anchor block for removably connecting or fastening the anchor block.

In some embodiments, the outer surface of the anchor block has grooves thereon for preventing slippage when removably connected or fastened with the engagement surface of the hanging clip.

In some embodiments, the engagement surface of the hanging clip has grooves thereon for preventing slippage when removably connected or fastened with the anchor block.

In some embodiments, the hanging clip is configured for an adjustable connection to the anchor block to provide a plurality of assembly configurations. For example, the cladding may be at different positions on the building and the hanging clip can change attachment configurations with embedded anchor block depending on cladding it secures. For example, bottom cladding may be supported by a different hanging clip attachment configuration than upper cladding. As another example, a different attachment configuration for the hanging clip may be used to secure multiple panels together and may vary depending on the number and position of the cladding panels.

In some embodiments, at least one bore on the body of the hanging clip is configured to provide vertical adjustment during cladding installation.

In another aspect, there is provided an anchor block having a core and two engaging portions outwardly projecting from the core, the two engaging portions operable to lock the anchor block in a mounting channel of a cladding panel in an interlocking fit when the anchor block is received or embedded within the mounting channel, and the anchor block having an outer surface that is configured to be flush or near flush with an surface of the cladding panel when the anchor block is received within the mounting channel, such that the cladding panel is operable to be secured to a building structure by engaging the anchor block.

In some embodiments, the anchor block has a dovetail shape.

In some embodiments, the anchor block has at least one bore extending inward from the outer surface, the bore being adapted to receive a fastener.

In some embodiments, adhesive material fills a gap between the anchor block and an inner surface of the mounting channel when the anchor block is received within the mounting channel. In some embodiments, the adhesive material is epoxy.

In some embodiments, the outer surface of the anchor block comprises grooves thereon for preventing slippage.

In another aspect, there is provided a method for installing a cladding panel onto a building structure, the cladding panel having a mounting channel extended across at least a part of a surface of the cladding panel, the anchor block having at least one bore extending inwardly from an outer surface thereof. The method may involve embedding the anchor block into the mounting channel of the cladding panel in an interlocking fit, such that an outer surface of the anchor block is flush or near flush with the surface of the cladding panel when the anchor block is received within the mounting channel; removably securing a hanging clip to the embedded anchor block by inserting a fastener through a corresponding bore extending through a body of the hanging clip and the at least one bore of the anchor block; and securing the cladding panel onto the building structure by connecting or fastening the hanging clip to a support.

In some embodiments, the method may involve sliding the anchor block into the mounting channel of the cladding panel.

In some embodiments, the method may involve filling a gap between the mounting channel and the embedded anchor block with adhesive material.

In some embodiments, the method may involve embedding the anchor block in position within the mounting channel using elastic materials.

In some embodiments, the anchor block has a core and two engaging portions outwardly projecting from the core, the two engaging portions operable to lock the anchor block in the mounting channel of the cladding panel in the interlocking fit when the embedded anchor block is received within the mounting channel.

In some embodiments, the mounting channel has a cross section complementary to a cross section of a shape of the embedded anchor block.

In some embodiments, the hanging clip comprises an engagement surface to engage the outer surface of the embedded anchor block.

In some embodiments, the hanging clip is removably connected or fastened with the anchor block by a threaded bolt or an expansion bolt.

In some embodiments, the method may involve adjusting a position of the hanging clip through the at least one corresponding bore to provide vertical adjustment of the cladding panel relative to the support.

In some embodiments, the support is removably coupled to the building structure and comprises at least one of an L bracket and a T bracket.

In some embodiments, the method may involve adjusting a position of the support to provide at least a horizontal adjustment of the cladding panel relative to the support.

In some embodiments, the anchor block comprises at least one of metal and reinforced plastics.

In some embodiments, the anchor block is linear or arc-shaped.

Other example embodiments are described herein.

BRIEF DESCRIPTION OF FIGURES

In the figures, various aspects and embodiments are shown, and described in connection therewith.

DETAILED DESCRIPTION

The discussion herein provides many example embodiments of the inventive subject matter. Although each embodiment represents a single combination of inventive elements, all possible combinations of the disclosed elements are considered to include inventive subject matter. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Described herein are systems and methods for hanging or anchoring cladding panels onto a building structure using cladding assemblies. An example cladding assembly may have an anchor block and a hanging clip. The anchor block may be referred to as an embedded anchor block with an outer surface that is configured to be flush or near flush with the surface of the cladding panel when the embedded anchor block is received within the mounting channel. Accordingly, the anchor block is "embedded" within the cladding panels. The cladding assembly may include an adhesive when an embedded anchor block is received within a cladding panel. The embedded anchor block may have a dovetail shape that complements a corresponding dovetail shape slot or mounting channel in the cladding panel. The embedded anchor block may be removably connected or fastened to the hanging clip. This may provide flexibility as different types of hanging clips may be used. The cladding assembly may enable replacement or removal of individual cladding panels or pieces during installation or repair. In addition, the embedded anchor block and hanging clip may facilitate certain amount of adjustability and the interlocking nature between the anchor block and the cladding panel, as well as between the hanging clip and the support structure, help avoid the need to put a bolt/fastener into the cladding panel itself during installation. The anchor block may be referred to herein as an embedded anchor block as it is configured to be received within a channel of the cladding panel.

Figure 1:
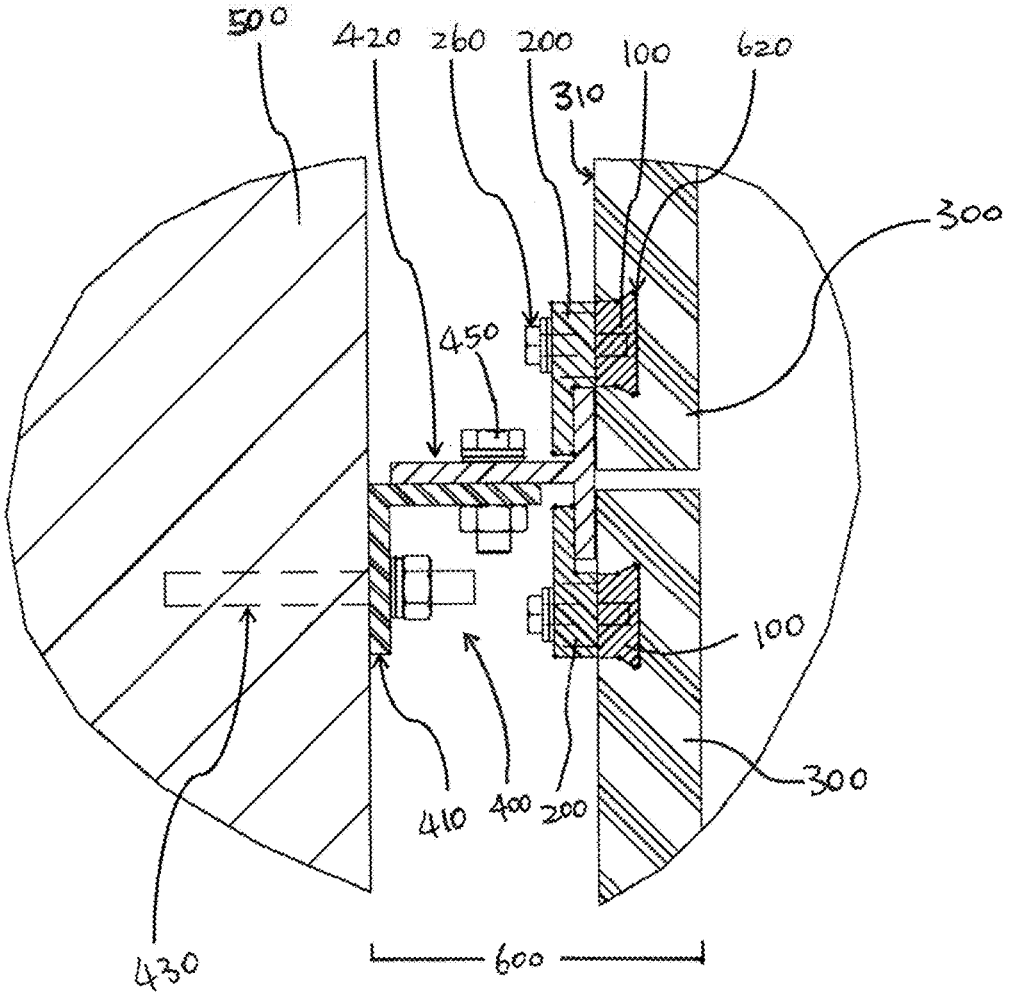
FIG. 1 is a cross-sectional view of an example system for hanging or anchoring cladding.

FIG. 1 is a cross-sectional view of an example system for hanging or anchoring cladding. As shown, a cladding assembly system 600 may facilitating the hanging of one or more cladding panels 300 onto a building structure 500. The system 600 may include an embedded anchor block 100 within a cladding panel 300 and a hanging clip 200 removably connected or fastened to the anchor block 100 by a fastener 260.

The embedded anchor block 100 may be received within a mounting channel 320 extending at least partly across a surface 310 of cladding panel 300. When received within the mounting channel 320, an adhesive material 620 may be used to fill a gap between the anchor block 100 and interior surface of mounting channel 320 of cladding panel 300. An example adhesive may be epoxy. In some embodiments, adhesive 620 may act as a lock and buffer for the cladding and the hanging assembly material. The adhesive 620 may provide a degree of elasticity between embedded anchor block 100 and cladding panel 300. This may be beneficial as materials of panel and embedded anchor may expand or contract at different extents due to temperature variation. For example, stone may expand in summer.

Figure 9:
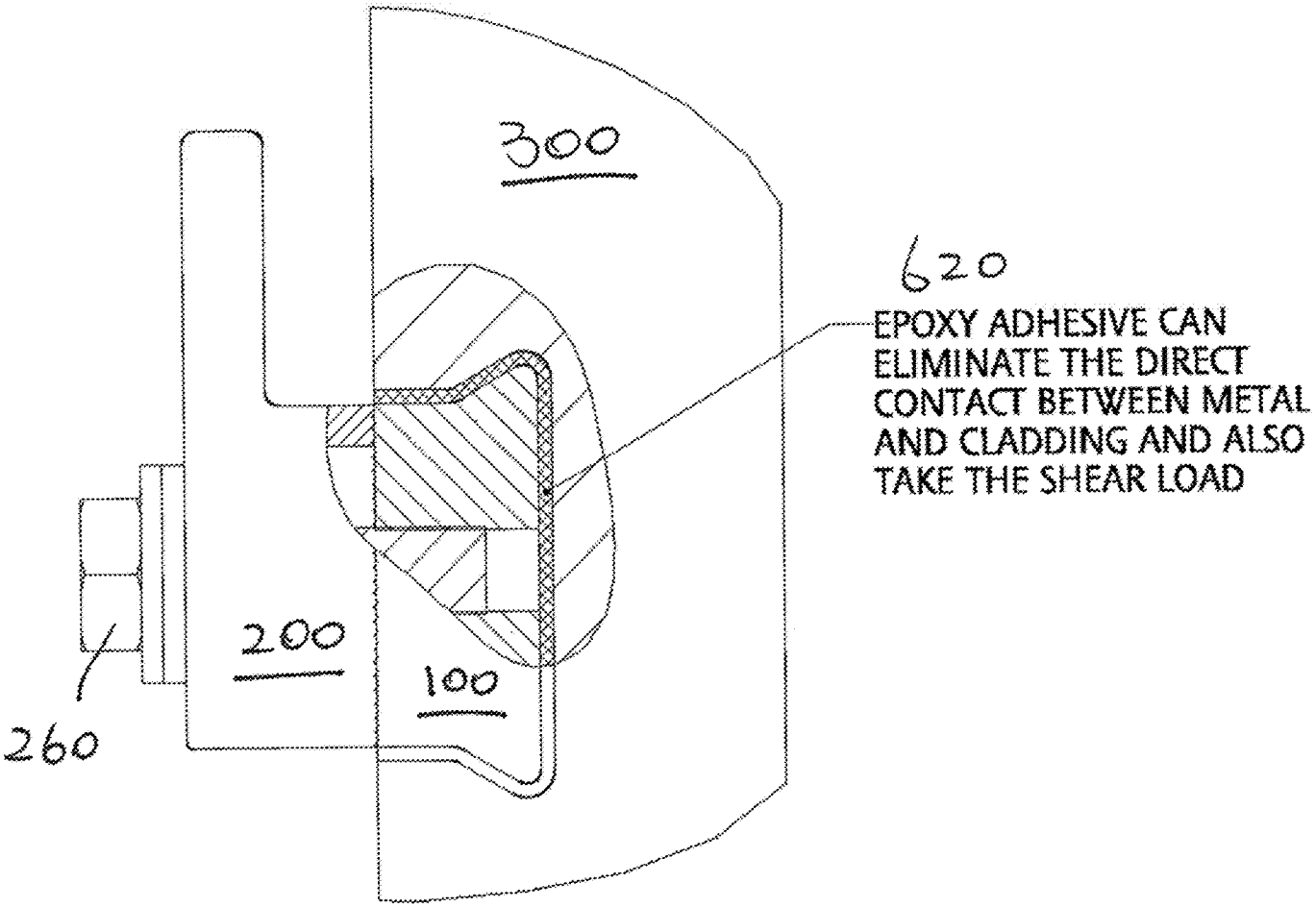
FIG. 9 shows a side view of an example anchor block embedded within a cladding panel and an example hanging clip removably fastened to the anchor block.

Referring now to FIG. 9, which shows a side view of an example embedded anchor block within a cladding panel and an example hanging clip removably fastened or connected to the anchor block, epoxy adhesive can also help eliminate or reduce direct contact between metal and cladding, and also take the sheer load.

Fastener 260 may be any suitable fastening means, for example, it may be a threaded bolt or expansion bolt.

Once a hanging clip 200 has been fastened to anchor block 100, a support structure or frame (or simply "support") 400 may be further removably connected or fastened to the hanging clip 200 and the cladding panel 300, for example in interlocking fit, to hang the cladding panel onto the building structure 500. Support 400 may include a number of configurations suitable to help secure the cladding panel onto the building structure with a hanging clip and an anchor block. For example, in FIG. 1, support 400 may include one or more of a T bracket or angle 420 and a L bracket 410, as shown. T bracket 420 may be removably connected or fastened to L bracket 410 by a fastener 450, which may comprise, for example, a bolt. The support 400 may be further removably connected or fastened to building structure 500 by a fastener 430, such as a bolt.

In some embodiment, as shown, an outer surface 130 of the embedded anchor block 100 is flush or near flush with a back surface 310 of cladding panel 300 when anchor block 100 is received within the cladding panel 300. This also allows an embedded depth of anchor block 100 to be consistent regardless of the thickness of cladding material or panel 300. That is, the anchor block is embedded within the cladding panel. In addition, a plurality of cladding panels, each with an anchor block 100 embedded, may be stacked with minimal wasted space between the panels as the anchor surface may be flush or near flush with the cladding panel 300, which improve product packing efficiency, and do not adversely affect the transportation. Shipping cost may be thereby saved.

In some embodiments, after fastening of hanging clip 200 onto anchor block 100, the cladding panels is installed on a keel system (or supporting frame) by a hanging method. If there is no keel system (or supporting frame) is installed, the cladding panel with hanging clips can be directly installed on supporting brackets 410, 420 which may be removably connected on building concrete block or steel structure 500. The location and number of connection points may be laid out according to pre-determined design and installation requirements.

In some embodiments, as assembled, a distance between the backside of the cladding panel 300 and the surface of the building structure 500 may be any were from 1 to 4 inches, as an illustrative example.

As described herein, the method of hanging a cladding panel 300 onto a building structure 500 is not restricted by surface conditions of cladding panel 300. The cladding surface can be in the format of flat plane, cylinder or other irregular shapes.

In some embodiments, support 400, hanging clip 200 and anchor block 100 as embedded within cladding panel 300 may together be referred to as a cladding assembly 600.

Figure 2A:
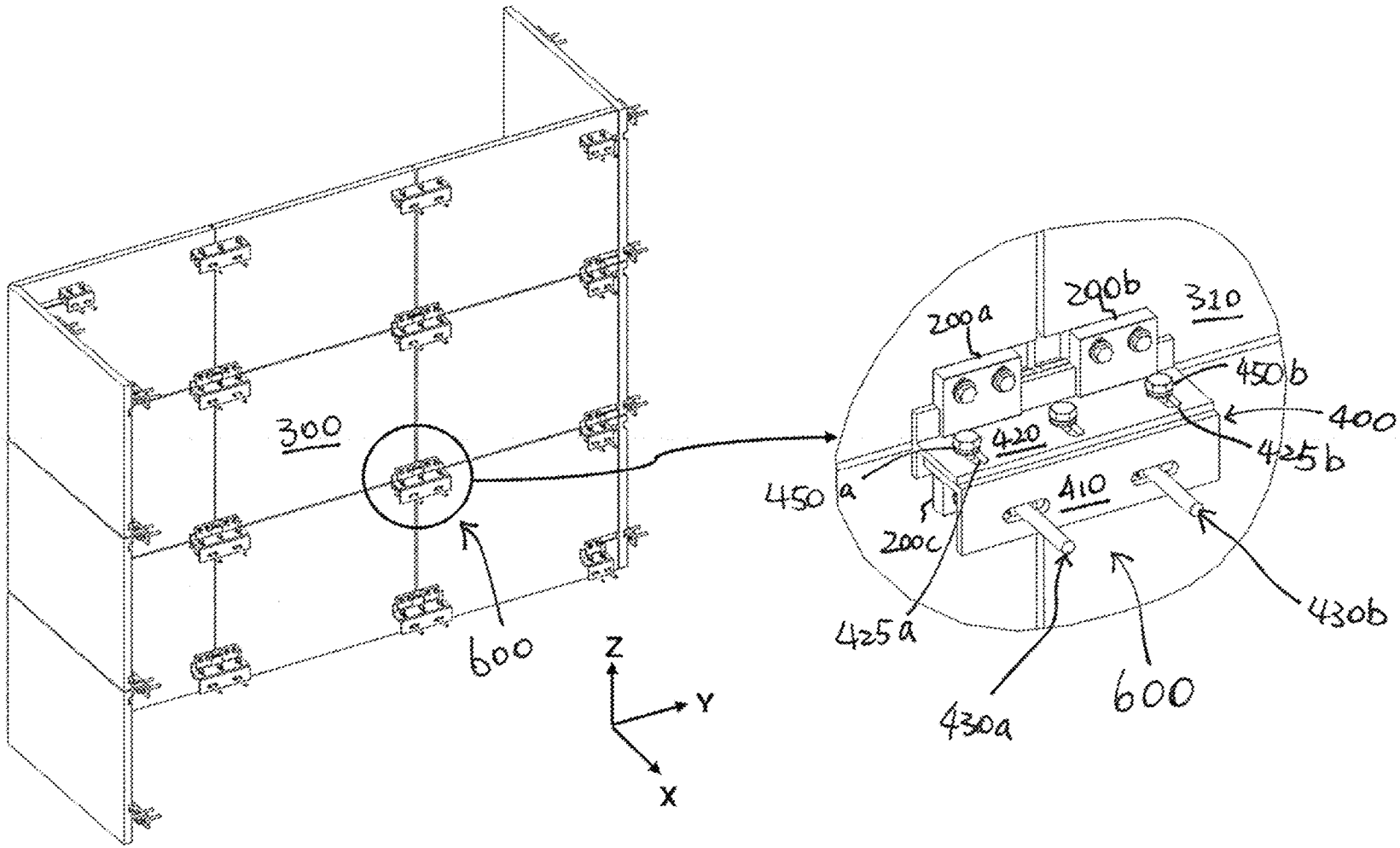
FIG. 2A is a perspective view showing an example system of cladding with a plurality of example cladding assemblies.

Referring now to FIG. 2A, a perspective view showing an example system of cladding with a plurality of example cladding assemblies is provided. A plurality of cladding panels 300 may be removably connected together by a plurality of cladding assemblies 600. For example, an anchor block and hanging clip assembly 600 that overlaps two or more panels may help with easy installation. For example, as shown in the blow-out view, cladding assembly 600 may comprise a plurality (e.g. four) anchor blocks 100 (not shown), each embedded within a corresponding cladding panel 300. Each anchor block 100 may be removably fastened to a corresponding hanging clip 200*a*, 200*b*, 200*c* (fourth hanging clip not visible). Each hanging clip 200*a*, 200*b*, 200*c* may be fastened to the corresponding anchor block 100 by way of one or more bores 220. A T bracket 420 may be removably fastened to the plurality of the hanging clips by way of interlocking fit. In one embodiment, the T bracket may be in an interlocking fit with a flange portion of each of the hanging clips 200*a*, 200*b*, 200*c*.

Each T bracket 420 may have one or more bores or slots 425*a*, 425*b*, each for receiving a fastener 450*a*, 450*b*. The fasteners 450*a*, 450*b* may removably secure a L bracket 410 onto the T bracket 420. L bracket 410 may comprise one or more bores for receiving one or more fasteners 430*a*, 430*b*. Fasteners 430*a*, 430*b* may further removably secure the cladding assembly 600, thus the entire cladding structure, onto a building structure 500.

Figure 2B:
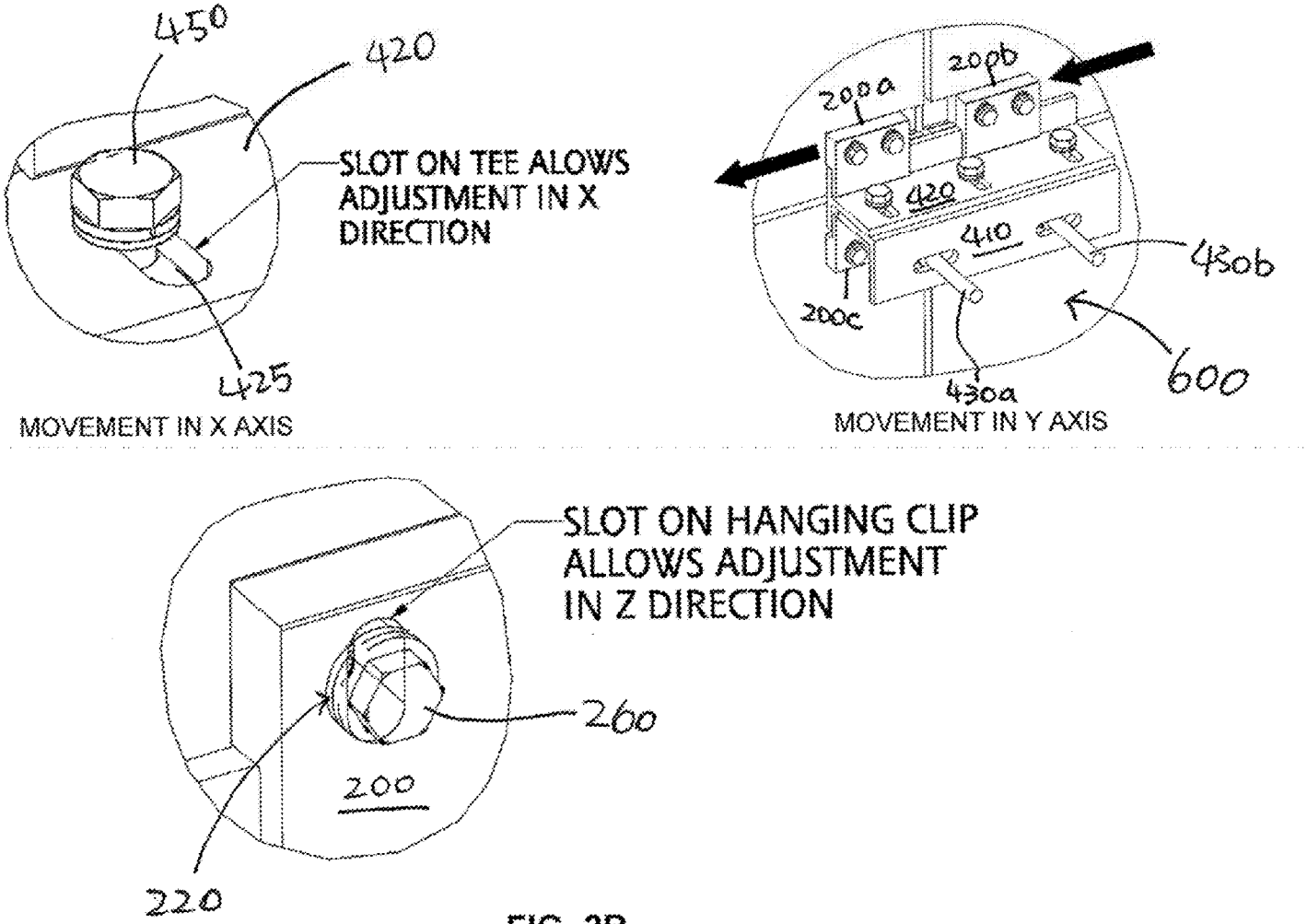
FIG. 2B shows perspective views of different components of a cladding assembly.

Referring now to FIG. 2B, a cladding assembly 600 may be easily adjusted in three directions, namely X, Y and Z, as shown. In X direction, flexibility and adjustability may be provided by adjustable placement of fastener 450 through an elongated slot or bore 425 on bracket 420. In Y direction, sliding one or more brackets 410, 420 in either direction may provide adjustability within a certain range of the cladding assembly 600. In Z direction, the adjustment of vertical location of cladding panel 300 can be quickly achieved by using shims with slot or bore 220 and fastener 260. This capability in free adjustment in three dimensions may improve accuracy of location of panel installation during construction process.

Figure 3:
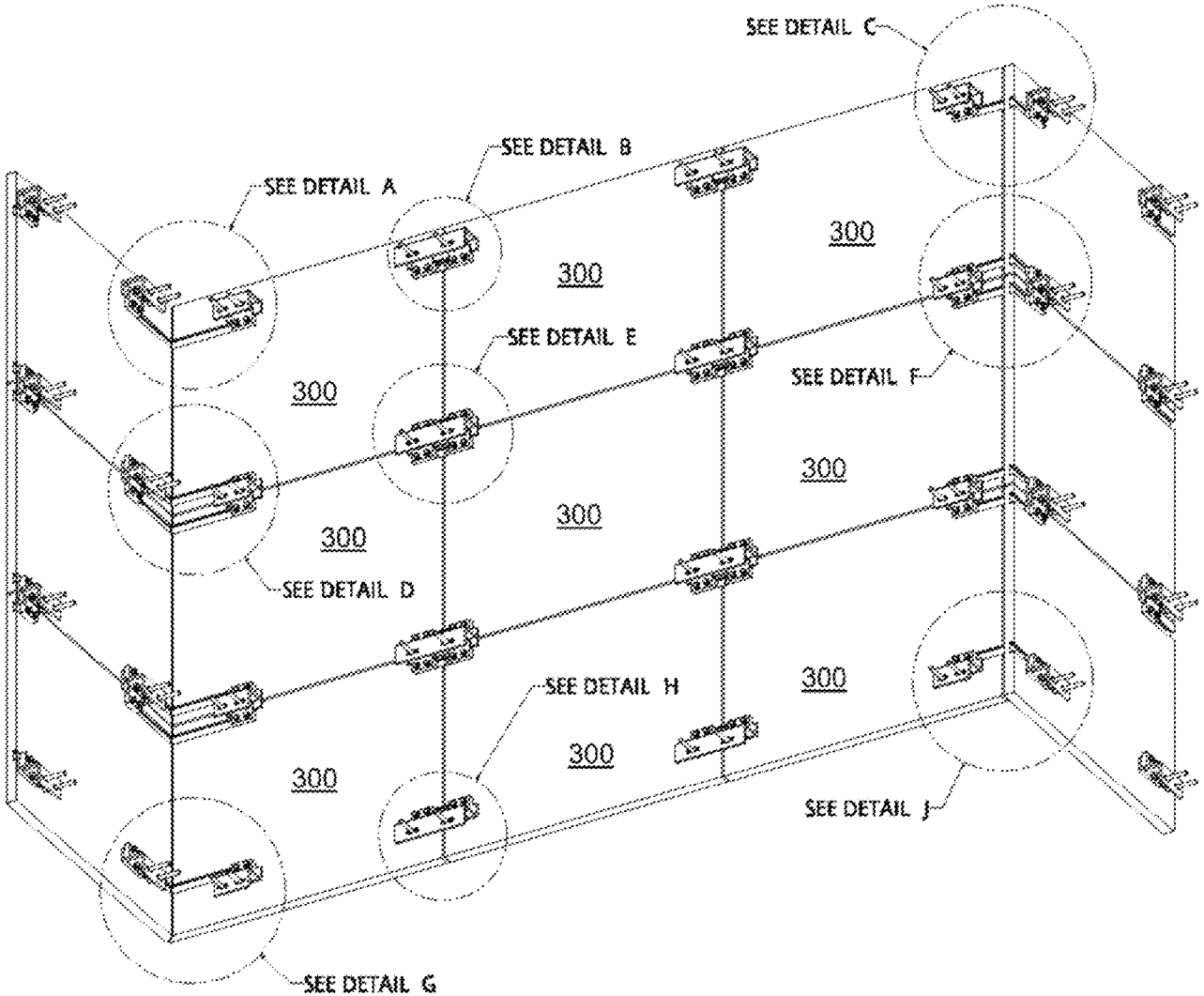
FIG. 3 shows a perspective view of another example system of cladding with a plurality of example cladding assemblies.

Referring now to FIG. 3, which shows a perspective view of another example system of cladding with a plurality of example cladding assemblies: configuration details A, B and C show various configurations of cladding assemblies 600 installed for top panels; configuration details D, E and F show various configurations of cladding assemblies 600 installed for middle panels; and configuration details G, H and J show various configurations of cladding assemblies 600 installed for bottom panels. As can be seen from FIGS. 4A to 4C, for each of details A to J, the cladding assembly on the left panel(s) may have identical components and configuration as cladding assembly on the right panel(s).

As described herein, the various configurations of cladding assemblies allow constructions workers to install individual cladding panels an order other than bottom-panels-first. That is, as each cladding panel can hold its own weight by being connected to a building structure via the cladding assembly, bottom panels do not have to be installed first. Traditionally, construction workers would have to install the bottom panels first as the bottom panels have to act as a support to a gravity wall and hold the weight of the upper panels.

Figure 4A:
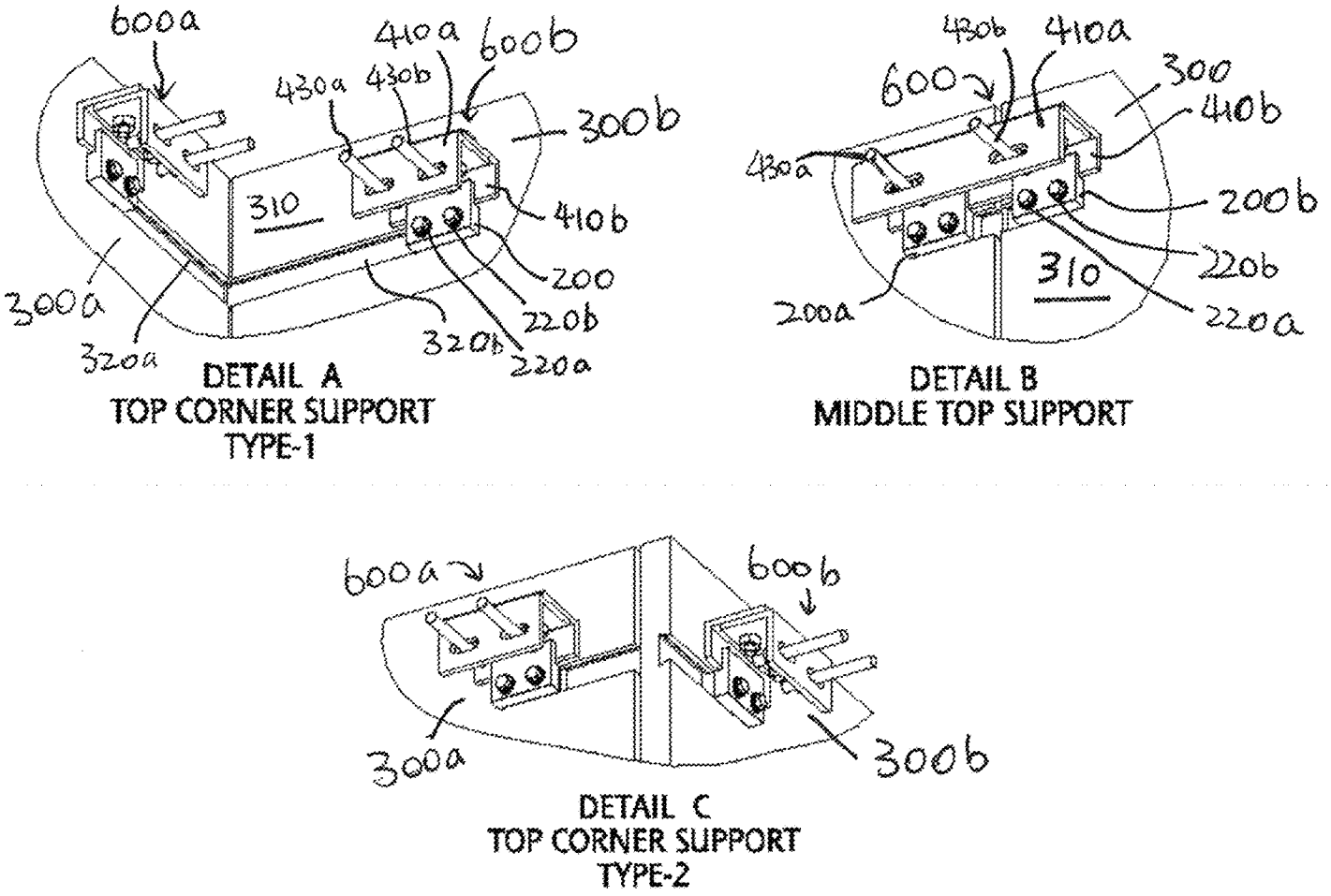
FIG. 4A shows perspective views of different configurations of example cladding assemblies for top panels.

FIG. 4A shows perspective views of different configurations of example cladding assemblies for top panels. Referring now to detail A, which shows two cladding assemblies 600*a*, 600*b* each mounted on respective top cladding panel 300*a*, 300*b*, as these two panels 300*a*, 300*b* are assembled to form a corner of less than or equal to 90 degrees. Hidden from view are anchor blocks 100 locked within mounting channels 320*a*, 320*b*. As can be seen, the cladding assembly 600*a* on the left has identical components and configuration as cladding assembly 600*b* on the right. Referring now to cladding assembly 600*b* installed on the right cladding panel 300*b* in detail A, only one anchor block 100 and one corresponding hanging clip 200 are required. Two bores 220*a*, 220*b* may be drilled in the hanging clip 200*b* for receiving fasteners 260 in order to removably fasten the hanging clip 200*b* to the corresponding anchor block 100 thus the panel 300*b*. In addition, support 400 may comprise two L brackets 410*a*, 410*b*. One of the L brackets 410*b* may have two bores for receiving corresponding fasteners 430*a*, 430*b* when mounted to a building structure (not shown).

Detail C in FIG. 4A shows identical assemblies 600*a*, 600*b* as those in detail A, except that in detail C, these two cladding panels 300*a*, 300*b* are assembled to form a corner greater than 90 degrees (e.g. 270 degrees).

Detail B in FIG. 4A shows a cladding assembly 600 for securing two top panels in the middle, which form more or less a flat or relatively flat surface. Similar to detail A, each cladding panel has an anchor block 100 mounted within a mounting channel 320 and removably fastened to a corresponding hanging clip 200*a*, 200*b*. A single piece L bracket 410*b* may be used to interlock both hanging clips 200*a*, 200*b*, and another single piece L bracket 410*a* may be removably fastened onto bracket 410*b*. L bracket 410*a* may have two slots or bores for receiving corresponding fasteners 430*a*, 430*b* when mounted to a building structure (not shown).

Figure 4B:
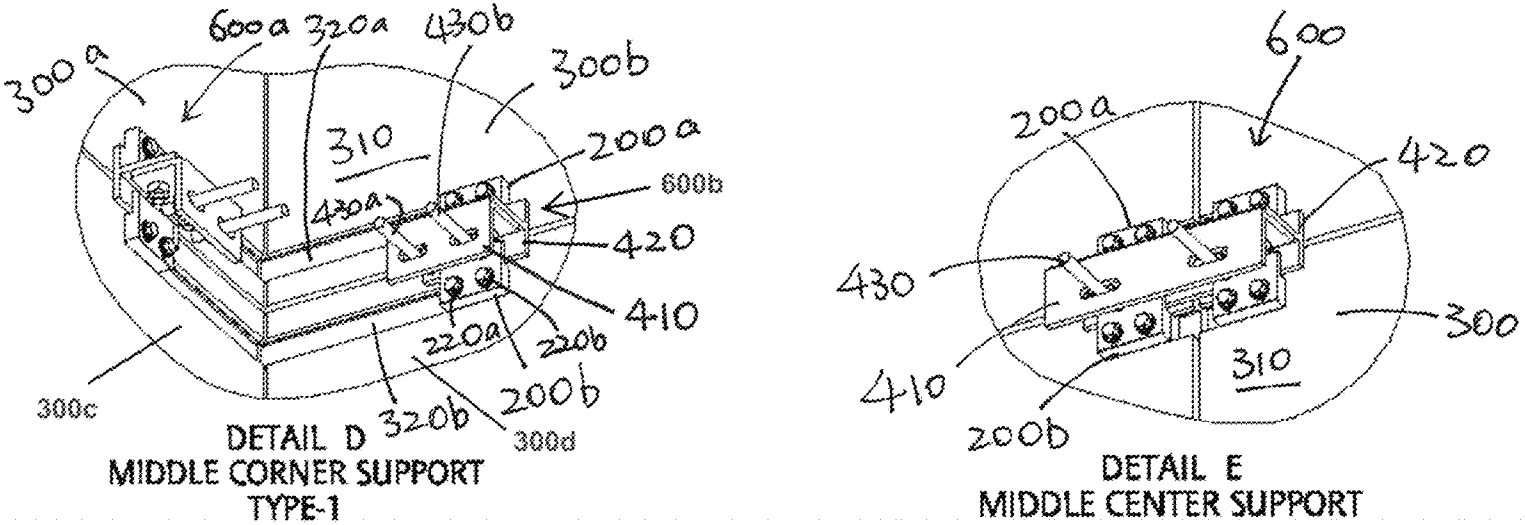
FIG. 4B shows perspective views of additional different configurations of example cladding assemblies for middle panels.

FIG. 4B shows perspective views of additional different configurations of example cladding assemblies for middle panels 300*a*, 300*b*, 300*c*, 300*d*. Referring now to detail D, which shows two cladding assemblies 600*a*, 600*b* each mounted on respective middle cladding panels as these four panels 300*a*, 300*b*, 300*c*, 300*d* are assembled to form a corner of less than or equal to 90 degrees. As can be seen, the cladding assembly 600*a* on the left has identical components and configuration as cladding assembly 600*b* on the right. Referring now to cladding assembly 600*b* installed on the right cladding panels 300*b*, 300*d* in detail D, hidden from view are a plurality (e.g. two) of anchor blocks 100, each locked within a respective mounting channel 320*a*, 320*b*, where each mounting channel 320*a*, 320*b* extends across at least partly across a surface 310 of a respective panel 300*b*, 300*d*. For each anchor block 100, a corresponding hanging clip 200*a*, 200*b* is fastened thereto. That is, each panel 300*a*, 300*b*, 300*c*, 300*d* may has its own anchor-block-and-hanging-clip system installed thereon. Two bores 220*a*, 220*b* may be drilled in each of the hanging clips 200*a*, 200*b* for receiving fasteners 260 in order to removably fasten the hanging clips 200*a*, 200*b* to the corresponding anchor block 100 thus the cladding panel 300*b*, 300*d*. For assembly 600*b* in detail D, hanging clip 200*a* and hanging clip 200*b* may share one support structure 400. Support 400 may comprise a L bracket 410 and a T bracket 420. L bracket 410 may have two or more bores for receiving corresponding fasteners 430*a*, 430*b* when mounted to a building structure (not shown).

Detail F in FIG. 4B shows identical assemblies 600*a*, 600*b* as those in detail D, except that in detail F, these four cladding panels 300*a*, 300*b*, 300*c*, 300*d* are assembled to form a corner greater than 90 degrees (e.g. 270 degrees).

Detail E in FIG. 4B shows a cladding assembly 600 for securing four panels in the middle, which form more or less a flat or relatively flat surface. Similar to detail D, each cladding panel has an anchor block 100 mounted within a mounting channel 320 and removably fastened to a corresponding hanging clip 200. A single piece T bracket 420 may be used to interlock all four hanging clips 200, and another single piece L bracket 410 may be removably fastened onto T bracket 420. L bracket 410 may have two slots or bores for receiving corresponding fasteners 430*a*, 430*b* when mounted to a building structure (not shown).

Figure 4C:
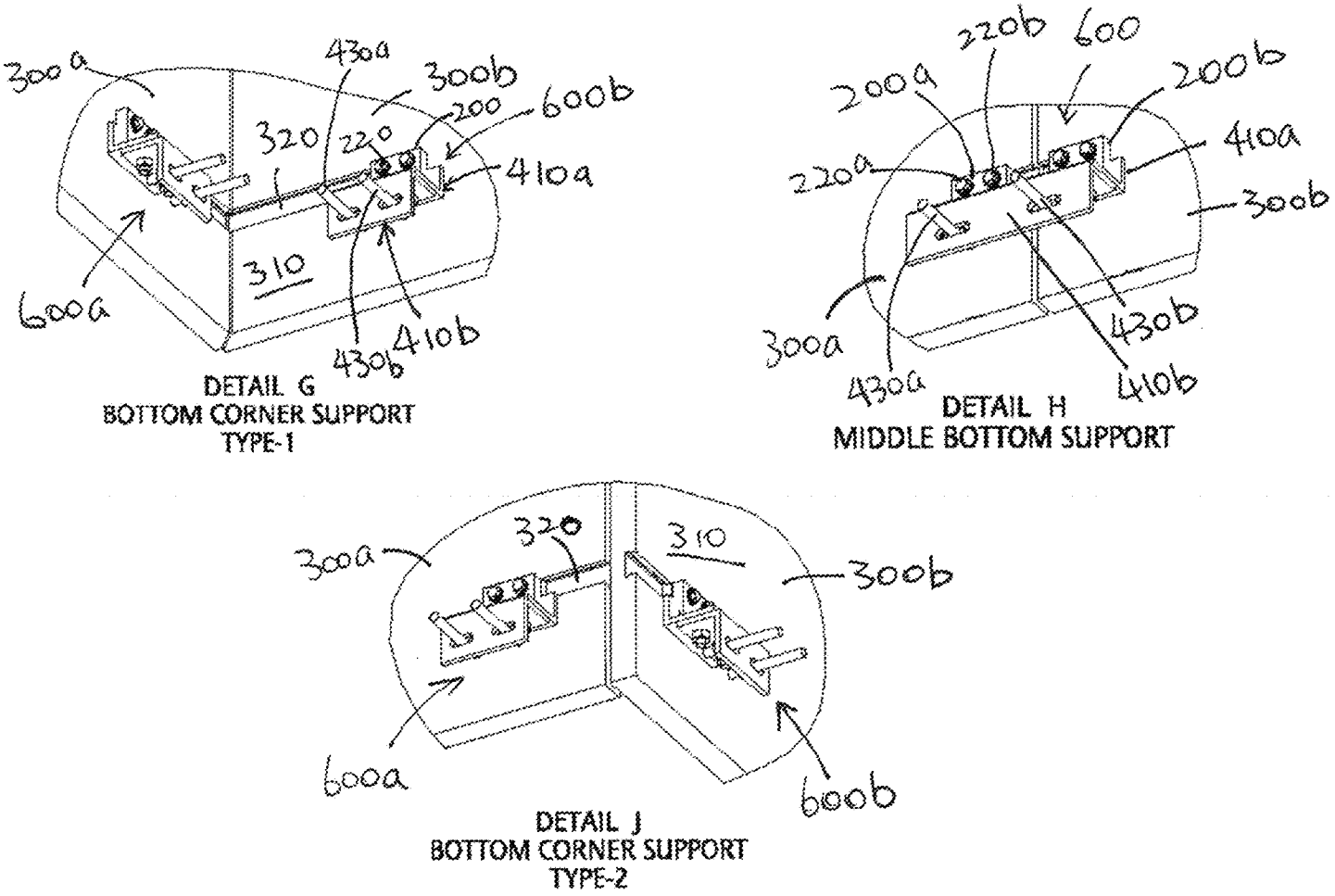
FIG. 4C shows perspective views of further different configurations of example cladding assemblies for bottom panels.

FIG. 4C shows perspective views of further different configurations of example cladding assemblies for bottom panels 300*a*, 300*b*. Referring now to detail G, which shows two cladding assemblies 600*a*, 600*b* each mounted on respective bottom cladding panel 300*a*, 300*b*, as these two panels 300*a*, 300*b* are assembled to form a corner of less than or equal to 90 degrees. Hidden from view are anchor blocks 100 locked within mounting channels 320. As can be seen, the cladding assembly 600*a* on the left has identical components and configuration as cladding assembly 600*b* on the right. Referring now to cladding assembly 600*b* installed on the right cladding panel 300*b* in detail G, only one anchor block 100 and one corresponding hanging clip 200 are required. Two bores 220 may be drilled in the hanging clip 200 for receiving fasteners 260 in order to removably fasten the hanging clip 200 to the corresponding anchor block 100 thus the panel 300*b*. In addition, support 400 may comprise two L brackets 410*a*, 410*b*. One of the L brackets 410*b* may have two or more bores for receiving corresponding fasteners 430*a*, 430*b* when mounted to a building structure (not shown).

Detail J in FIG. 4A shows identical assemblies 600*a*, 600*b* as those in detail G, except that in detail J, these two cladding panels 300*a*, 300*b* are assembled to form a corner greater than 90 degrees (e.g. 270 degrees).

Detail H in FIG. 4A shows a cladding assembly 600 for securing two bottom panels in the middle, which form more or less a flat or relatively flat surface. Similar to detail G, each cladding panel has an anchor block 100 mounted within a mounting channel 320 and removably fastened to a corresponding hanging clip 200*a*, 200*b*. A single piece L bracket 410*a* may be used to interlock both hanging clips 200*a*, 200*b*, and another single piece L bracket 410*b* may be removably fastened onto bracket 410*a*. L bracket 410*b* may have two or more slots or bores for receiving corresponding fasteners 430*a*, 430*b* when mounted to a building structure (not shown).

Embodiments described herein may provide a method for installing a cladding panel onto a building structure, the cladding panel having a mounting channel extended across at least a part of a surface of the cladding panel, the anchor block having at least one bore extending inwardly from an outer surface thereof. The method may involve embedding the anchor block into the mounting channel of the cladding panel in an interlocking fit, such that an outer surface of the anchor block is flush or near flush with the surface of the cladding panel when the anchor block is received within the mounting channel; removably securing a hanging clip to the embedded anchor block by inserting a fastener through a corresponding bore extending through a body of the hanging clip and the at least one bore of the anchor block; and securing the cladding panel onto the building structure by connecting or fastening the hanging clip to a support. As shown in FIGS. 4A and 4B the method may involve different configurations of the hanging clip depending on the type of support provided and the positions of the cladding panel to support. The method may be repeated to secure multiple cladding panels in different configurations. In some embodiments, the method may involve adjusting a position of the support to provide at least a horizontal adjustment of the cladding panel relative to the support.

In some embodiments, the support is removably coupled to the building structure and comprises at least one of an L bracket and a T bracket. Different bracket configurations and types may be used depending on the desired configuration of the hanging clip. This provides flexibility in design as embedded anchors and hanging clips may be used to support various cladding panels in different positions relative to the building support.

The method may involve sliding the anchor block into the mounting channel of the cladding panel and/or involve filling a gap between the mounting channel and the embedded anchor block with adhesive material. The method may involve embedding the anchor block in position within the mounting channel using elastic materials. The method may involve adjusting a position of the hanging clip through the at least one corresponding bore to provide vertical adjustment of the cladding panel relative to the support.

In some embodiments, the anchor block has a core and two engaging portions outwardly projecting from the core, the two engaging portions operable to lock the anchor block in the mounting channel of the cladding panel in the interlocking fit when the embedded anchor block is received within the mounting channel. In some embodiments, the mounting channel has a cross section complementary to a cross section of a shape of the embedded anchor block. In some embodiments, the hanging clip comprises an engagement surface to engage the outer surface of the embedded anchor block. In some embodiments, the hanging clip is removably connected or fastened with the anchor block by a threaded bolt or an expansion bolt.

Figure 5:
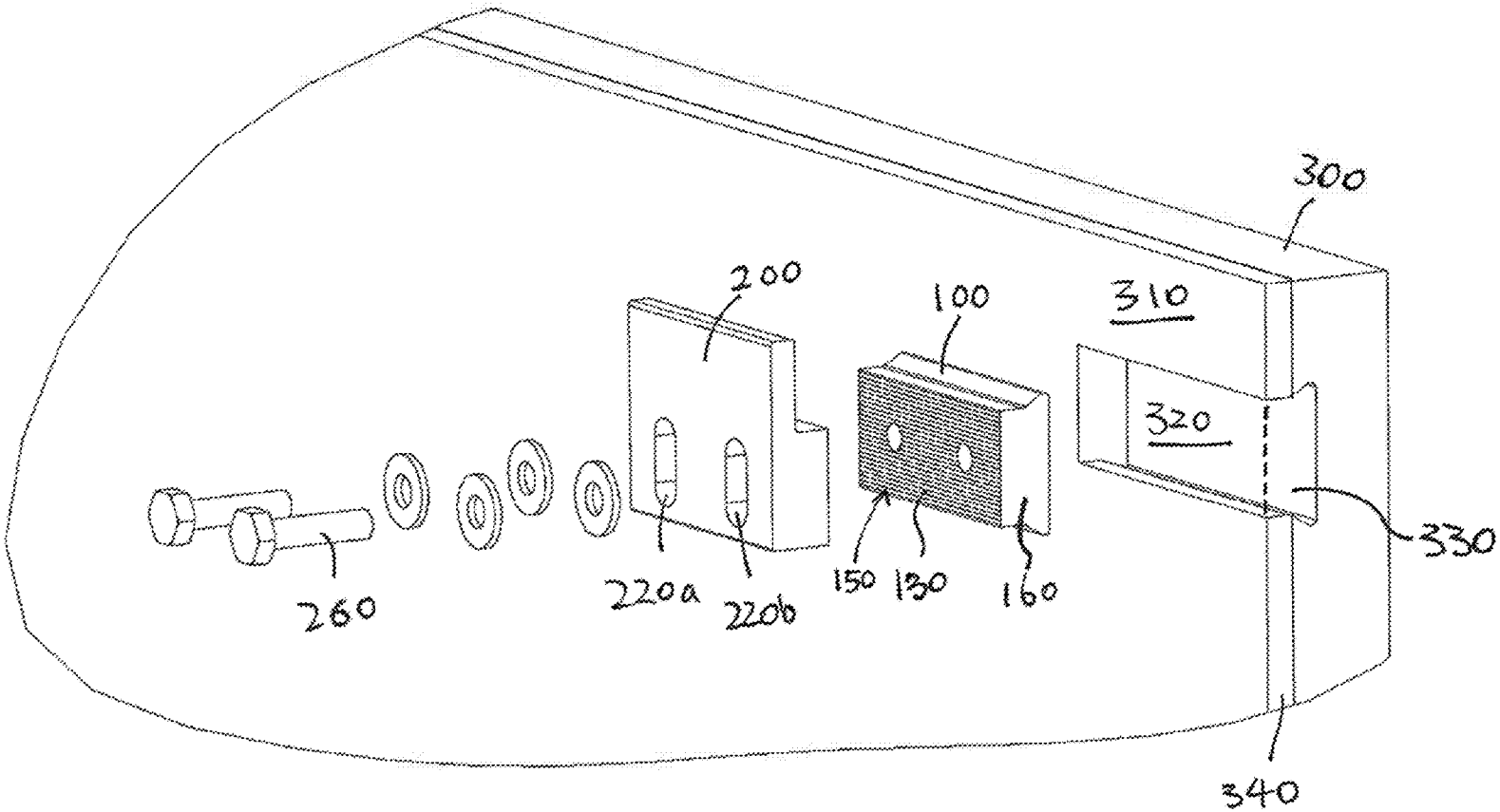
FIG. 5 is an exploded view of an example anchor block and an example hanging clip system with a cladding panel.

FIG. 5 is an exploded view of an example anchor block 100 and an example hanging clip 200 system with a cladding panel 300. Cladding panel 300 may comprise a mounting channel 320 extending at least partly across a surface 310 thereof. Anchor block 100 may have an outer surface 130 that is configured to be flush or near flush with the surface 310 of the cladding panel 300 when the anchor block is received within the mounting channel in an interlocking fit. A cross section 330 of mounting channel 320 may have a complementary outline or shape as a corresponding cross section 160 of anchor block 110.

In some embodiment, anchor block 100 has a dovetail shape as shown. The dovetail shape may facilitate an interlocking fit between anchor block 100 and mounting channel 320 when anchor block 100 is received within mounting channel 320. As described herein, anchor block 100 may have any other suitable shape.

A hanging clip 200 may be configured to be removably fastened to anchor block 100, the hanging clip having an engagement surface 210 to engage the outer surface 130 of anchor block 100, where the cladding panel 300 is operable to be secured to a building structure 500 by fastening anchor block 100 to the hanging clip 200 which is removably securable to a support 400.

In some embodiments, anchor block 100 may have at least one bore 140 extending inward from outer surface 130 and hanging clip 200 has at least one corresponding bore 220 to removably fasten hanging clip 200 to anchor block 100 with a fastener 260 through bores 220, 140. Fasteners 260 may be threaded or expansion bolts. In addition, flat washers or lock washers may be used with fasteners 260 to removably connect hanging clip 200 and anchor block 100.

In some embodiments, adhesive material may be used to fill a gap between anchor block 100 and an inner surface of mounting channel 320 when anchor block 100 is received within mounting channel 320.

In some embodiments, outer surface 130 of anchor block 100 may comprise grooves 150 thereon for preventing slippage when removably fastened with hanging clip 200.

In some embodiments, in order to increase the impact resistance of the cladding panel, a reinforcing layer 340 can be added on the surface, such as carbon fiber and resin, glass fiber and resin, and so on. The reinforcing layer can cover the surface 310 of cladding panel 300 in the form of cloth, mesh, grid or grating. A function of reinforcing layer 340 is to prevent cladding from shattering when it is broken. This greatly increases the safety factor in real application to lower the risk of injury by falling cladding materials.

In some embodiments, entire surface of the decorative panels, mesh, such as strengthening the grid-like layer 340 may be enhanced to increase its impact resistance such that damage may be avoided or minimized.

Figure 6:
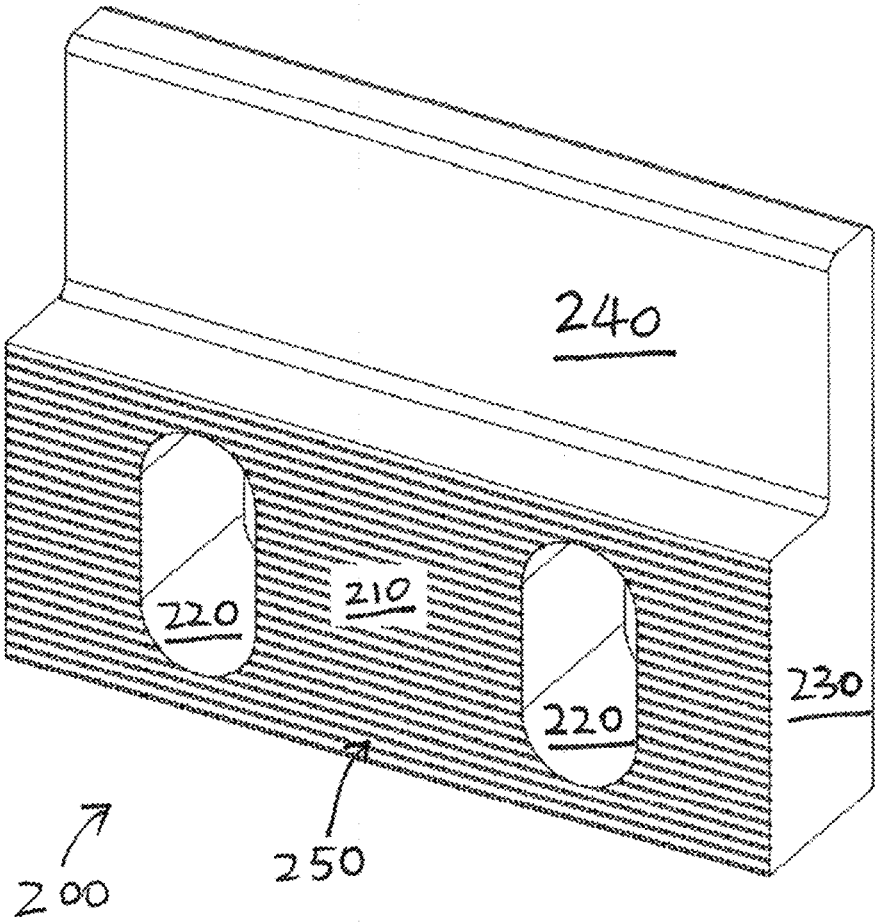
FIG. 6 is a perspective view of an example hanging clip.

FIG. 6 is a perspective view of an example hanging clip 200 in accordance with some embodiments. Hanging clip 200 may comprise a body 230 and a flange 240 projecting outwardly from the body 230, wherein the body having the at least one slot or bore 220 corresponding to each of at least one bore 140 of anchor block 100 for removably connecting or fastening the anchor block 100.

An engagement surface 210 of hanging clip 200 may comprise grooves 250 thereon for preventing slippage when engagement surface 210 is in contact with outer surface 130 of anchor block 100.

Grooves 150, 250 on anchor block 100 or hanging clip 200 may help increase friction or act a pure mechanic lock if necessary.

Figure 7:
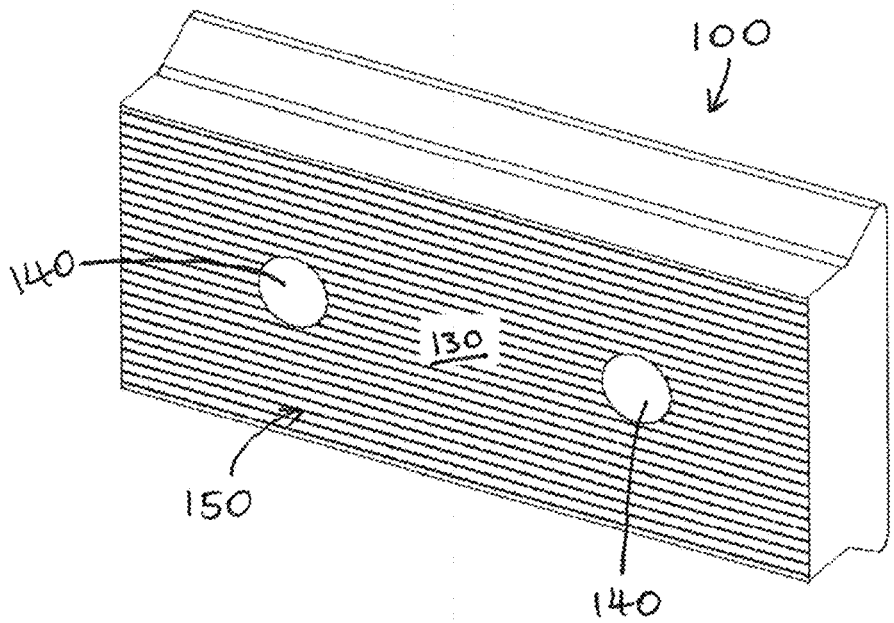
FIG. 7 is a perspective view of an example anchor block.

FIG. 7 is a perspective view of an example anchor block 100. As can be seen, anchor block 100 may have an outer surface 130 that is configured to be flush or near flush with the surface 310 of the cladding panel 300 when the anchor block is received within the mounting channel in an interlocking fit. One or more bores 140 may be drilled into anchor block 100 for engaging with hanging clip 200.

Figure 8A:
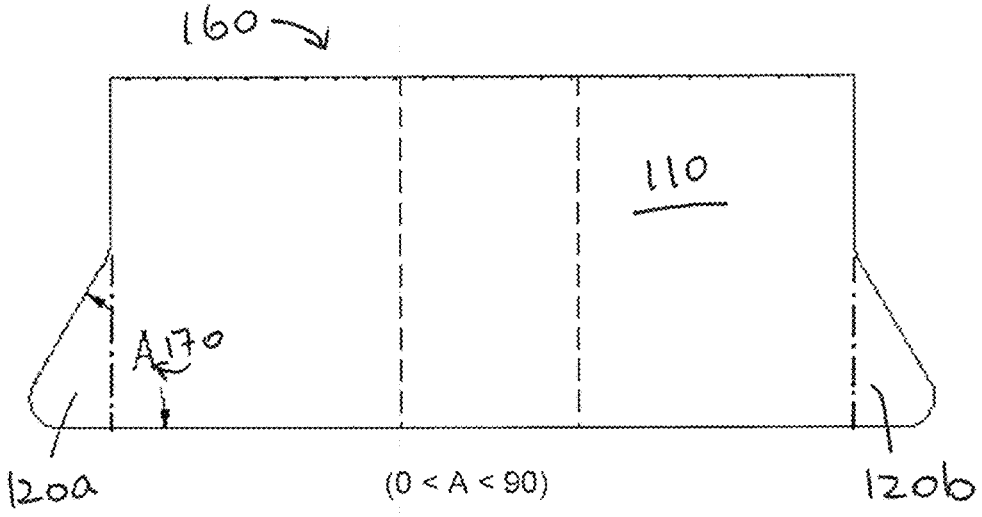
FIG. 8A shows a cross-sectional view of an example anchor block with dovetail portions.
Figure 8B:
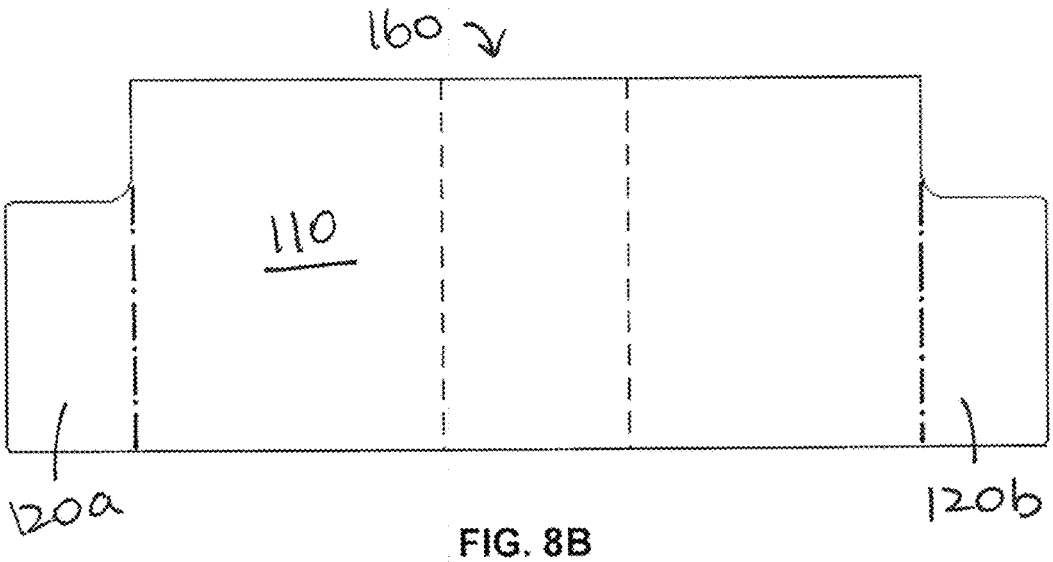
FIG. 8B shows a cross-sectional view of an example anchor block with square portions.
Figure 8C:
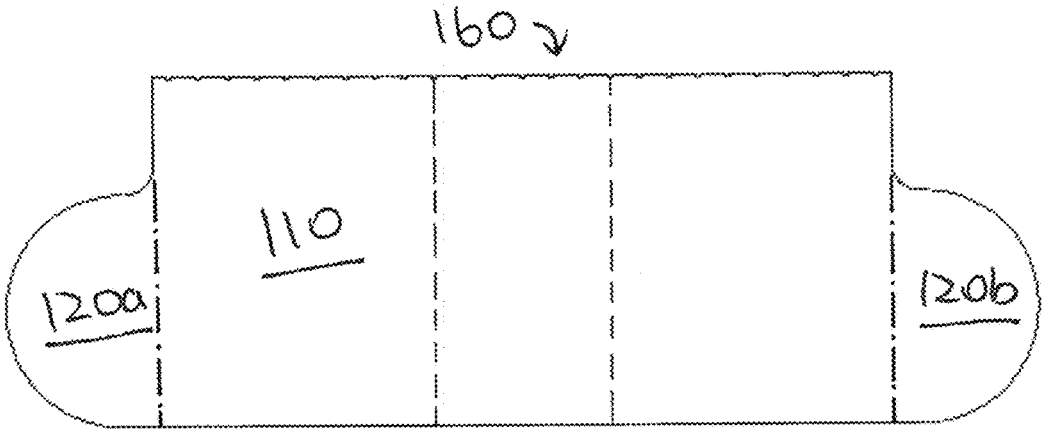
FIG. 8C shows a cross-sectional view of an example anchor block with round portions.

Referring now to FIGS. 8A to 8C, cross-section views of various embodiments of anchor block 100 are shown. As can be seen, anchor block 100 may have a core 110 and two engaging portions 120 outwardly projecting from the core, the two engaging portions 120 operable to lock anchor block 110 in mounting channel 320 of cladding panel 300 in an interlocking fit when anchor block 100 is received within mounting channel 320.

In FIG. 8A, anchor block 100 may comprise a dovetail shape. Two engaging portions 120*a*, 120*b* may each have an angle 170 of A degrees, where A may be greater than 0 and less than 90 degrees. In FIG. 8B, the two engaging portions 120*a*, 120*b* may each be in the form of a rectangle or a square. In FIG. 8C, the two engaging portions 120*a*, 120*b* may each be in the form of a semi-circle or generally round shape.

In some embodiment, anchor block 100 may comprise material such as metal, reinforced plastics, or any other suitable material. In one embodiment, anchor block 100 as well as hanging clip 200 may comprise aluminum.

Anchor block 100 can be linear, arc (such as for cylindrical column) or other shapes as required. The number of threaded holes or bare holes 140 on anchor block 100 can be one or more. The narrow surface of the dovetailed anchor is aligned with the back surface of cladding panel or circular column, hanging clip is connected with the embedded anchor by mechanical fasteners.

Referring now to FIG. 9, which shows a side view of an example anchor block 100 embedded within a cladding panel 300 and an example hanging clip 200 removably fastened to the anchor block. As can be seen, adhesive material 620 may be used to eliminate direct contact between anchor block 100 (e.g. metal) and cladding panel 300. The adhesive material 620 can also take or share shear load.

In accordance with one aspect of the invention, a method for installing a cladding panel onto a building structure is described herein. During operation, a cladding panel may first be pre-fabricated with a mounting channel extending at least partly across a surface thereof. Alternatively, cladding panel may be modified in a workshop to have the mounting channel carved into a surface thereof. Next, anchor block may be slid or otherwise placed into the mounting channel of the cladding panel in an interlocking fit, such that an outer surface of the anchor block is flush or near flush with the surface of the cladding panel when the anchor block is received within the mounting channel. Next, a hanging clip may be removably fastened to the anchor block by inserting a fastener through a bore extending through a body of the hanging clip and at least one corresponding bore of the anchor block. Finally, the cladding panel may be installed or hung onto the building structure by fastening the hanging clip to a support. The support may comprise at least one of a T bracket and a L bracket.

In some embodiments, the anchor block may be squeezed in position within the mounting channel by using suitable engineering plastics, elastic or adhesive materials.

In some embodiments, a position of the hanging clip may be adjusted to a certain degree through the at least one corresponding bore of the hanging clip to provide vertical adjustment of the cladding panel relative to the support.

In some embodiments, a position of a component in the support (e.g. T bracket or L bracket) may be adjusted to provide at least a horizontal adjustment of the cladding panel relative to the support.

Figure 10B:
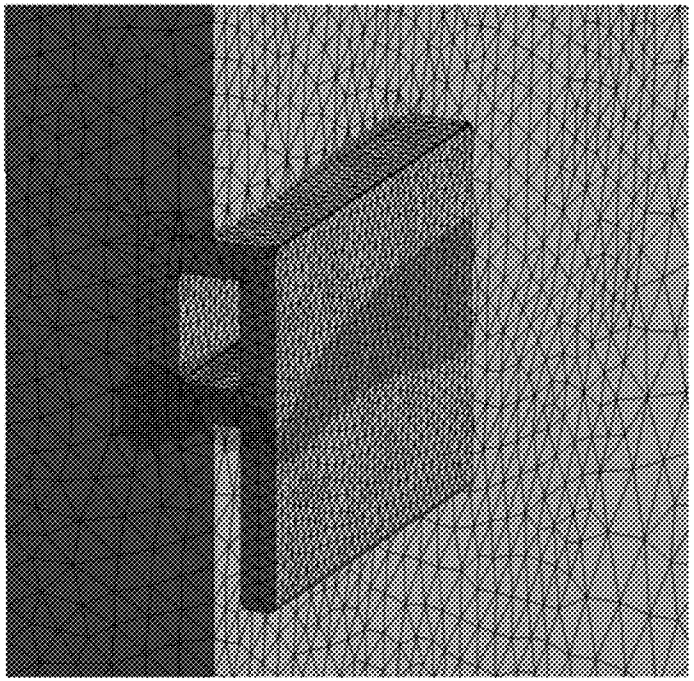
FIG. 10B demonstrates stress analysis on an anchor block and a hanging clip providing a hanging assembly.
Figure 10A:
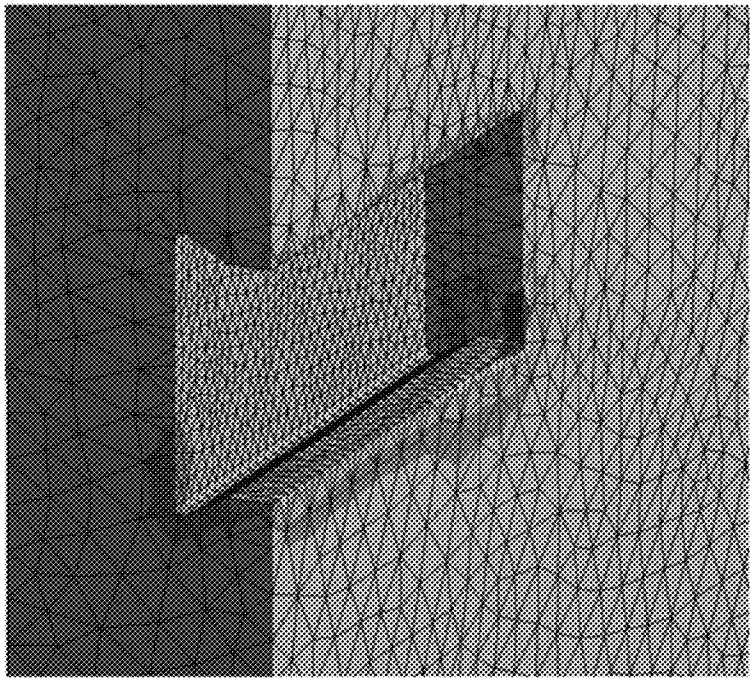
FIG. 10A demonstrates stress analysis on cladding panel.

FIG. 10A demonstrates stress analysis by FEA on a cladding panel. FIG. 10B demonstrates stress analysis by FEA on an anchor block and a hanging clip assembled.

Figure 11:
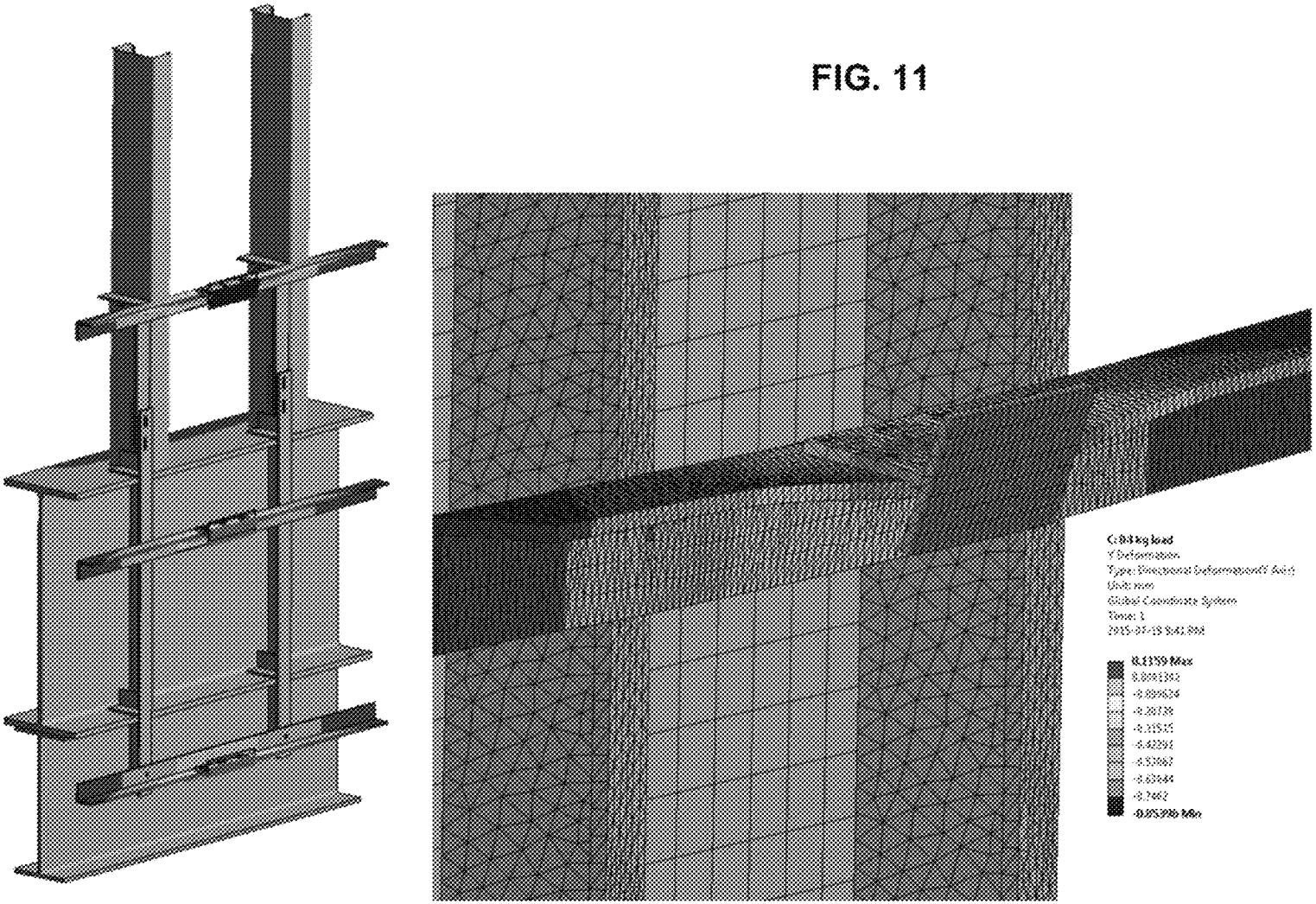
FIG. 11 shows deflection analysis for a cladding supporting structure.

FIG. 11 shows deflection analysis by FEA for a cladding supporting structure under design load.

Figure 12:
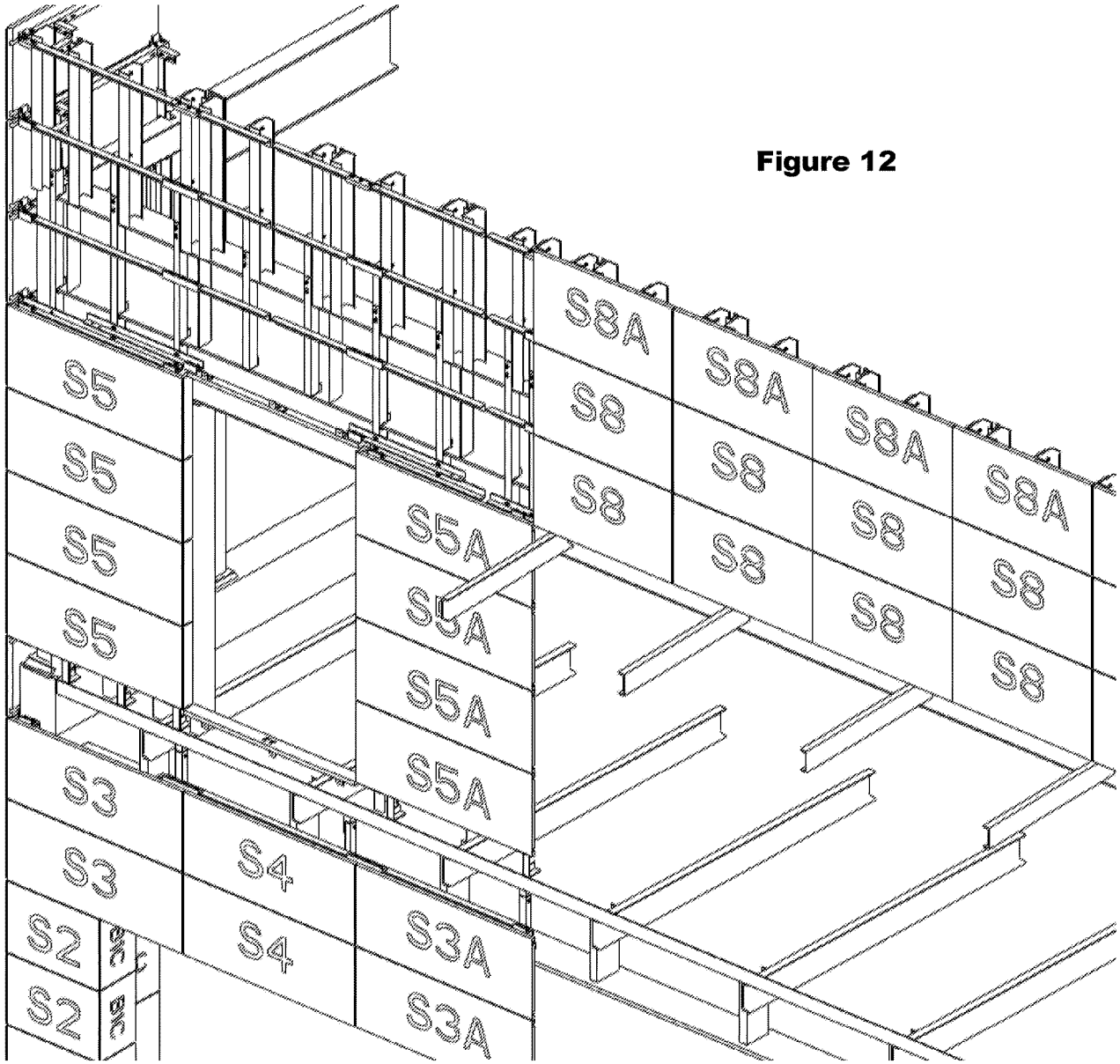
FIG. 12 shows an example installation sequence of the cladding assembly system.

FIG. 12 shows an example installation sequence of the cladding assembly system. As shown, cladding panels may be supported on a building using the hanging assembly described herein. The cladding panels may be attached using various sequences and configurations given the flexible and adaptable hanging assembly which may facilitate the construction process.

In some embodiments, the cladding systems and methods described herein may provide ease of use during manufacturing process and site construction procedure. For example, it may benefit from maximum in-shop fabrication. On a construction site, only several operations are required to complete the installation work, such as position adjustment, mechanical fastening, simple adhesive bonding and so on. Operations on site do not tend to require highly skilled worker, such as experienced masonries, and general labors can complete the installation work. Under this condition, site installation efficiency may be increased, installation time may be greatly shortened, unit labor rate can be thereby reduced.

In some embodiments, the systems and methods for cladding described herein may shift a large amount of man-hours generally required on construction site into workshop. This further reduces a high cost at site construction site and replace such high cost with a lower cost at workshops, which at the same time, also increases accuracy of manufacturing.

In some embodiments, the systems and methods for cladding described herein may also minimize adverse effects from weather and climate conditions, and consequently minimizes some risks in delay of project delivery.

In some embodiments, the systems and methods for cladding described herein may also reduce waste generation on site and provide a green and environmental-friendly construction environment. Waste generated by the process is generally easy to handle, environmentally friendly, and may be dealt with easily at a waste processing plant.

In some embodiments, the systems and methods for cladding may relate to natural stone, artificial stone ceramic tiles, and other building materials as decorative panels. The back of the decorative panel may have an extending channel or groove that may open wide at an edge to receive the embedded anchors with threaded holes (or hole) to removably connect to the hanging clips via corresponding pendant with bolt (or bolts). The connection may be provided with screws to fix the body member (e.g. cladding) to the hanging assembly (anchor, hanging clip). A trim panel may be used in some embodiments for practicability and value.

In some embodiments, the systems and methods for cladding or new decorative panels may be produced entirely within the factory for benefits such as high precision, less-site adjustment, uniform force transfer, and reasonable stress distribution.

In some embodiments, with neatly machined surface of the cladding panels, transportation may be convenient. For example, the embedded anchor supports may be flush or near flush with the surface of the cladding panels so that the cladding panels may be stacked without excess wasted space that may results from components protruding or extending out of the cladding panels. A stack of cladding panels with the embedded anchor supports therein may be substantially the same height as the same stack of cladding panels (i.e. the same number of cladding panels in the stack) without the embedded anchor supports. The embedded anchor supports may be made of relatively light weight material to reduce excess weight for shipping.

These are illustrative example embodiments and there may be other variations and modifications.

What is claimed is:

1. A cladding panel assembly comprising:

a cladding panel comprising a mounting channel having a length and extending at least partly across a surface thereof; and an embedded anchor block having a core and two engaging portions outwardly projecting from the core, the anchor block having a length less than a length of the mounting channel, the anchor block shaped to move to a plurality of positions along the length of the mounting channel, the two engaging portions operable to lock the embedded anchor block in the mounting channel of the cladding panel in an interlocking fit when the embedded anchor block is received within the mounting channel, and the embedded anchor block having an outer surface that is configured to be flush or near flush with the surface of the cladding panel when the embedded anchor block is received within the mounting channel.

2. The assembly of claim 1, wherein the embedded anchor block has a dovetail shape.

3. The assembly of claim 1, wherein the mounting channel has a cross section complementary to a cross section of a shape of the embedded anchor block.

4. The assembly of claim 1, further comprising a hanging clip configured to removably connect or fasten to the embedded anchor block, the hanging clip having an engagement surface to engage the outer surface of the embedded anchor block, wherein the cladding panel is operable to be secured to a building structure by fastening the embedded anchor block to the hanging clip which is securable to a support.

5. The assembly of claim 4, the embedded anchor block having at least one bore extending inward from the outer surface, and the hanging clip having at least one corresponding bore to removably connect or fasten the hanging clip to the embedded anchor block.

6. The assembly of claim 5, the hanging clip having a body and a flange projecting outwardly from the body, the body having at least one bore corresponding to the at least one bore of the embedded anchor block for removably connecting or fastening the embedded anchor block.

7. The assembly of claim 1, wherein adhesive material is used to fill a gap between the embedded anchor block and an inner surface of the mounting channel when the embedded anchor block is received within the mounting channel.

8. The assembly of claim 3, wherein the outer surface of the embedded anchor block comprises grooves thereon for preventing slippage when removably connected or fastened with the engagement surface of the hanging clip.

9. The assembly of claim 8, wherein the engagement surface of the hanging clip comprises grooves thereon for preventing slippage when removably connected or fastened with the embedded anchor block.

10. The assembly of claim 1, wherein the cladding panel further comprises a reinforcing layer on the surface in a form of at least one of cloth, mesh and grating.

11. The assembly of claim 4, wherein the hanging clip is configured for an adjustable connection to the embedded anchor block to provide a plurality of assembly configurations.

12. The assembly of claim 6, wherein the at least one bore on the body of the hanging clip is configured to provide vertical adjustment during cladding installation.

13. A kit for hanging a cladding panel onto a building structure, the cladding panel comprising a mounting channel extending at least partly across a surface thereof, the kit comprising:

(a) an anchor block having a core and two engaging portions outwardly projecting from the core, the anchor block having a length less than a length of the mounting channel, the anchor block shaped to move to a plurality of positions along the length of the mounting channel, the two engaging portions operable to lock the anchor block in the mounting channel of the cladding panel in an interlocking fit when the embedded anchor block is received within the mounting channel, and the embedded anchor block having an outer surface that is configured to be flush or near flush with the surface of the cladding panel when the embedded anchor block is received within the mounting channel; and (b) a hanging clip configured to removably connect or fasten to the anchor block, the hanging clip having an engagement surface to engage the outer surface of the anchor block, wherein the cladding panel is operable to be secured to a building structure by fastening the anchor block to the hanging clip which is securable to a support.

14. The kit of claim 13, wherein the anchor block has at least one bore extending inward from the outer surface and wherein the hanging clip has at least one corresponding bore to removably connect or fasten the hanging clip to the anchor block.

15. The kit of claim 14, wherein the hanging clip comprises a body and a flange projecting outwardly from the body, wherein the body having the at least one corresponding slot or bore to the at least one bore of the anchor block for removably connecting or fastening the anchor block.

16. The kit of claim 13, wherein the outer surface of the anchor block comprises grooves thereon for preventing slippage when removably connected or fastened with the engagement surface of the hanging clip.

17. The kit of claim 16, wherein the engagement surface of the hanging clip comprises grooves thereon for preventing slippage when removably connected or fastened with the anchor block.

18. The kit of claim 13, wherein the hanging clip is configured for an adjustable connection to the anchor block to provide a plurality of assembly configurations.

19. The kit of claim 15, wherein the at least one bore on the body of the hanging clip is configured to provide vertical adjustment during cladding installation.

20. A method for installing a cladding panel onto a building structure, the cladding panel having a mounting channel extended across at least a part of a surface of the cladding panel to receive an anchor block, the anchor block having a length less than a length of the mounting channel, the anchor block having at least one bore extending inwardly from an outer surface thereof, the method comprising:

sliding the anchor block along the length of the mounting channel to a plurality of positions and embedding the anchor block into the mounting channel of the cladding panel in an interlocking fit, such that an outer surface of the anchor block is flush or near flush with the surface of the cladding panel when the anchor block is received within the mounting channel;

removably securing a hanging clip to the embedded anchor block by inserting a fastener through a corresponding bore extending through a body of the hanging clip and the at least one bore of the anchor block; and securing the cladding panel onto the building structure by connecting or fastening the hanging clip to a support.

* * * * *